United States Patent [19]

Herout et al.

[11] 4,140,622

[45] Feb. 20, 1979

[54] PROCESS TO REDUCE THE BENZENE CONTENT OF GASOLINE

[75] Inventors: Richard C. Herout, Palatine; Kenneth D. Uitti, Bensenville, both of Ill.

[73] Assignee: UOP Inc., Des Plaines, Ill.

[21] Appl. No.: 848,058

[22] Filed: Nov. 3, 1977

[51] Int. Cl.[2] ..... C07C 3/52; C10G 39/00

[52] U.S. Cl. ..... 208/93; 260/671 R; 260/671 P

[58] Field of Search ..... 208/93; 260/671 R, 671 P

[56] References Cited

U.S. PATENT DOCUMENTS

| | | | |
|---|---|---|---|
| 2,335,596 | 11/1943 | Mareschner | 260/671 R |
| 2,730,557 | 1/1956 | Max et al. | 260/671 R |
| 2,955,143 | 10/1960 | Bloch | 260/671 R |

*Primary Examiner*—Herbert Levine

*Attorney, Agent, or Firm*—James R. Hoatson, Jr.; John F. Spears, Jr.; William H. Page, II

[57] ABSTRACT

Benzene, which is toxic and carcinogenic, is removed from a gasoline or gasoline precursor stream, such as a mixture of a reformate and a naphtha produced in a fluidized catalytic cracking unit, in a process which includes fractionating the precursor stream into a light hydrocarbon stream containing the benzene and a heavy hydrocarbon stream. The light hydrocarbon stream is then admixed with an olefinic hydrocarbon, passed through an alkylation zone and then remixed with the heavy hydrocarbon stream.

9 Claims, No Drawings

PROCESS TO REDUCE THE BENZENE CONTENT OF GASOLINE

FIELD OF THE INVENTION

The invention relates to a hydrocarbon conversion process having a gasoline boiling range feed stream. The invention also relates to a method of treating a gasoline stream for the removal of benzene. A limited embodiment of the invention relates to the alkylation of benzene with a $C_3$ or $C_4$ olefin at an olefin to aromatic hydrocarbon ratio above 1.0:1.0 through the use of an SPA catalyst.

PRIOR ART

Large amounts of benzene are present in several of the streams used in refineries as blending stocks for gasoline. These include reformates and the gasoline produced in an FCC gas concentration unit. Some of this benzene has traditionally been removed, as by liquid-liquid extraction, to be used as a petrochemical feedstock and for other purposes. However, the great majority of benzene present in gasoline precursor streams has been allowed to remain in these streams since it is readily abundant and has an acceptable octane number.

The alkylation of benzene is widely practiced commercially. For instance, the alkylation of benzene with propylene to form cumene is described in U.S. Pat. Nos. 3,132,109 (Cl. 252-435); 3,293,315 (Cl. 260-671); 3,499,826 (Cl. 203-27); 3,510,534; 3,520,945 and 4,008,290 (Cl. 260-672). These references also describe solid phosphoric acid (SPA) catalysts. Another catalyst system utilizes boron trifluoride to effect the alkylation of benzene with ethylene and propylene. This alkylation process is described in U.S. Pat. Nos. 2,995,611 (Cl. 260-671); 3,126,421; 3,238,268 and 3,894,090. A large number of other catalyst systems are known. Examples are found in U.S. Pat. Nos. 2,887,520 and 3,336,410.

The contacting of gasolines produced by catalytic cracking with an SPA catalyst was performed in a process referred to as polytreating. This process is described in an article which appears at page 1045 of Vol. 38, No. 10 of *Industrial and Engineering Chemistry* published in October, 1946. The conditions employed in the process included a temperature from about 400° F. to 560° F. and a pressure in excess of 400 psig. The objective of the invention was to lower the concentration of various olefinic constituents which, by virtue of their low lead susceptibility, were considered less desirable. The article specifies aromatic hydrocarbons of the gasoline undergo virtually no change during the polytreating reactions and this is described as highly desirable. Among the reactions listed as occurring during the process are the polymerization of olefins, the cyclization of higher olefins to naphthenes and the hydrogenation of olefins present in the original gasoline by hydrogen produced in other reactions.

BRIEF SUMMARY OF THE INVENTION

The invention provides a process for treating gasoline streams to remove benzene which does not have a major adverse impact on the octane number or total aromatics content of the gasoline stream being treated. The process may be broadly characterized as comprising the steps of passing a gasoline precursor stream comprising less than 5.0 mole percent benzene, 1.0 mole percent toluene, at least 5.0 mole percent $C_4$ to $C_6$ paraffinic hydrocarbons, at least 10.0 mole percent $C_8$ to $C_{10}$ aromatic hydrocarbons and also containing $C_7$ to $C_9$ paraffinic hydrocarbons into a fractionation zone, and separating the gasoline precursor stream into a light fraction comprising substantially all of the benzene contained in the gasoline precursor stream and a heavy fraction comprising substantially all of the toluene and higher boiling hydrocarbons contained in the gasoline precursor stream; admixing an olefin feed stream comprising olefinic hydrocarbons having from 2 to 4 carbon atoms per molecule into the light fraction of the gasoline precursor stream to form a reaction zone feed stream; passing the reaction zone feed stream through an alkylation reaction zone maintained at benzene-alkylation promoting conditions and effecting the production of a reaction zone effluent stream comprising an aromatic hydrocarbon having from 8 to 10 carbon atoms per molecule and $C_4$ and $C_6$ paraffinic hydrocarbons and which contains less than 1.0 mole percent benzene; passing the reaction zone effluent stream into a separation zone and effecting the division of the reaction zone effluent stream into a light separation zone effluent stream comprising a $C_3$ or $C_4$ hydrocarbon and a heavy separation zone effluent stream comprising substantially all of the aromatic hydrocarbons contained in the reaction zone effluent stream; and admixing the heavy separation zone effluent stream with the heavy fraction of the gasoline precursor stream to form a low benzene content gasoline blending stream.

DETAILED DESCRIPTION

Benzene is present in the gasoline boiling range effluent streams of several petroleum refining processes. These processes include catalytic reforming, coking, pyrolysis and fluidized catalytic cracking. Some of the benzene in gasoline boiling range streams is recovered and purified, as by liquid-liquid extraction and fractionation, for use as a petrochemical product or feedstock. However, the amount of benzene present in the total of the streams used for gasoline production far exceeds the amount required to satisfy the demand for benzene. Most of the benzene in gasoline boiling range streams is therefore allowed to remain in these streams and is eventually used in gasoline.

Benzene is now coming under close scrutiny as a possible carcinogen or leukemogen. Its presence in gasoline therefore presents the possibility that service station operators, motorists and others are being exposed to harmful benzene concentrations on a regularly recurring basis. It is an objective of the invention to provide a process for treating a gasoline boiling range hydrocarbon stream to reduce its benzene content. It is another objective of the invention that this reduction of the benzene content of gasoline precursor streams be accomplished in an economical process which has minimal adverse effect on the octane number of the gasoline precursor stream. Yet another objective of the invention is to remove benzene from gasoline boiling range streams in a manner which does not create an oversupply of benzene, thus causing a reduction in its market value, and which converts the benzene to a high value product.

Benzene may of course be eliminated from gasoline precursor streams in the same manner it is now partially removed for benzene production. For instance, reformates may be fractionated to yield a $C_6$ to $C_8$ cut which is then fed to a liquid-liquid extraction zone and contacted with a solvent selective for aromatic hydrocarbons. The resultant extract stream is separated to yield an aromatic hydrocarbon product stream from which the benzene may be separated by fractionation. A suitable aromatic hydrocarbon extraction process is described in U.S. Pat. Nos. 3,492,222; 3,642,614 and 3,652,452. If the gasoline precursor stream is derived from a catalytic cracking process, it will normally be necessary to hydrotreat the precursor stream prior to charging it into the liquid-liquid extraction zone. The benzene produced in this manner may be alkylated to yield styrene, cumene or a long chain alkylate used to manufacture detergents.

The subject process is used to treat a gasoline precursor stream. The phrase "gasoline precursor stream" is intended to refer to a stream comprising a mixture of aromatic and paraffin hydrocarbons having boiling points between about 90° F. and 410° F. and which is to be used to produce gasoline. Gasolines are often produced by blending together several different hydrocarbon streams. Some of these streams do not contain benzene, and therefore do not require treatment by the subject invention. For instance, benzene-free branched chained paraffinic hydrocarbon streams, such as those produced by the HF-catalyzed alkylation of isobutane, may be admixed into the gasoline precursor stream. However, this admixture is preferably done downstream of the subject process in order to avoid the unnecessary treating of this material. Likewise, any addition of butane or other light hydrocarbons to adjust the volatility of the product gasoline is also preferably done downstream of the subject benzene removal process.

The gasoline precursor or feed stream will normally contain about 0.5 to 5.0 or higher mole percent benzene. It will also contain various $C_7$ to $C_{10}$ aromatic hydrocarbons including about 1.0 mole percent toluene and at least 10 mole percent of $C_8$ to $C_{10}$ aromatic hydrocarbons. The total concentration of all aromatic hydrocarbons in the gasoline precursor stream may be above 25 mole percent. The gasoline precursor stream will also normally contain some $C_4$ to $C_6$ paraffinic hydrocarbons. These may include butane, isopentane, isohexane and n-hexane and will normally be present at a concentration above 5.0 mole percent. $C_7$ to $C_9$ paraffinic hydrocarbons such as isoheptane and iso-octane are also present in many gasoline precursor streams. The concentration of these paraffins will normally be above 2.0 mole percent and may be above 5.0 or 15.0 mole percent. The exact composition of the gasoline precursor stream will depend on its source. It may be formed by blending all or a portion of the effluent of several different petroleum processing units. Two such effluents are the bottoms product of the stripper column used in FCC gas concentration units and stabilized reformates which contain $C_6$ to $C_9$ aromatic hydrocarbons.

The feed stream of the subject process is fed into a fractionation zone maintained at suitable fractionation conditions. Preferably, this zone comprises a single trayed fractionation column which is sized according to well known criteria based on the flow rate and composition of the feed stream. The conditions used in this zone may be those which are customary in the art. A positive pressure of about 5 to 450 psig. is preferred. The temperature required is dependent on the pressure and the feed stream composition but is preferably within the broad range of from 250° F. to 650° F. as measured at the bottoms draw-off point of the zone. A precise split between the various components of the feed stream is not required. The criteria for operation of the fractionation zone is that substantially all of the benzene contained in the feed stream is separated into a separate stream, which will be the overhead product of the fractionation zone. As used herein, modifiers such as "substantially all" are intended to refer to molar percentages above 95%. Preferably, over 98 mole percent of the benzene is contained in the overhead product stream of the fractionation zone, which is also referred to herein as the light hydrocarbon stream. Some toluene may also be present in this light hydrocarbon stream, but most of the toluene is preferably retained in the heavy hydrocarbon stream removed as the bottoms product of the fractionation zone. The overhead product of the zone will also contain various $C_4$ to $C_6$ paraffinic hydrocarbons contained in the feed stream, while substantially all $C_8$ to $C_{10}$ aromatic hydrocarbons will be contained in the heavy hydrocarbon stream.

A reaction zone charge stream is formed by admixing one or more olefinic hydrocarbons into the light hydrocarbon stream produced in the fractionation zone. Suitable hydrocarbons are ethylene, propylene and the butylenes. High purity streams of one olefin may be used if available, but mixtures of the olefins may also be employed in the invention. Preferably, the olefin feed stream is rich in olefins and contains less than 25 mole percent non-olefinic hydrocarbons. The preferred composition of the feed stream containing the added olefins will be influenced by several factors. One of the most important will be the reactions promoted by the catalyst employed in the downstream benzene alkylation zone and the effects of olefin feed stream composition on the reaction zone product distribution. With some catalysts, it may be beneficial to utilize a high purity olefin stream or to minimize the presence of light paraffins such as butane. However, it is preferred to utilize a catalyst which will tolerate various amounts of these unreactive light hydrocarbons. This allows the use of lower purity gas streams. One such gas stream is that produced as the overhead product stream of the stripping column employed in a typical FCC gas concentration plant. This gas stream may comprise methane, ethane, ethylene, propane, propylene, butane and various butenes. An olefin-rich $C_3$ to $C_4$ stream derived from the stripping column overhead may also be used.

The reaction zone charge stream is brought into intimate contact with a catalyst in an alkylation reaction zone maintained at benzene alkylation-promoting conditions. A homogeneous catalyst system may be employed if desired. These include hydrofluoric acid systems, sulfuric acid systems and various Friedel-Crafts catalysts such as the aluminum chloride ($AlCl_3$) system described in U.S. Pat. No. 3,848,012 (Cl. 260-671R). The catalyst employed in the alkylation reaction zone preferably comprises a fixed bed of solid material. For instance, a crystalline aluminosilicate such as described in U.S. Pat. Nos. 3,751,504; 3,751,506 and 3,755,483 may possibly be employed. Another suitable catalyst system employs a gaseous catalyst promoter which is circulated through a bed of solid carrier particles. These carrier particles are normally inorganic oxides such as the gamma and theta forms of alumina, silica, boria and various naturally occurring inorganic oxides including clays and diatomaceous earth. The vaporous catalyst promoter is preferably a halogen-containing compound such as boron trifluoride, boron trichloride, hydrogen chloride, carbon tetrachloride, hydrogen fluoride, ammonium fluoride and ammonium chloride. More preferably, the catalyst promoter is boron trifluoride. This catalyst system is further described in U.S. Pat. Nos. 3,126,421; 3,631,122 and 3,894,090.

The preferred catalyst for use in the subject process is a solid phosphoric acid (SPA) catalyst. One reason for this preference is its propensity to produce monoalkylated aromatic hydrocarbons from benzene and propylene compared to most other catalyst systems. Suitable solid phosphoric acid catalysts are available commercially. As used herein, the term "SPA catalyst" or its equivalent is intended to refer generically to a solid catalyst which contains as one of its principal raw ingredients an acid of phosphorus such as ortho-, pyro- or tetraphosphoric acid. These catalysts are normally formed by mixing the acid with a siliceous solid carrier to form a wet paste. This paste may be calcined and then crushed to yield catalyst particles, or the paste may be extruded or pelleted prior to calcining to produce more uniform catalyst particles. The carrier is preferably a naturally occurring porous silica-containing material such as kieselguhr, kaolin, infusorial earth and diatomaceous earth. A minor amount of various additives such as mineral talc, fullers earth and iron compounds including iron oxide have been added to the carrier to increase its strength and hardness. The combination of the carrier and the additives normally comprises about 15–30 wt.% of the catalyst, with the remainder being the phosphoric acid. However, the amount of phosphoric acid used in the manufacture of the catalyst may vary from about 8–80 wt.% of the catalyst as described in U.S. Pat. No. 3,402,130. The amount of the additives may be equal to about 3–20 wt.% of the total carrier material. Further details as to the composition and production of typical SPA catalysts may be obtained from U.S. Pat. Nos. 3.050,472; 3,050,473 and 3,132,109 and from other references.

The reaction or alkylation zone is maintained at benzene-alkylation promoting conditions. A general range of these conditions includes a pressure of from about 50 to 1200 psig. and a temperature of from about 60° F. to 850° F., and their selection is dependent on the catalyst system employed. With SPA catalyst the pressure is preferably from 300 to 1000 psig. and the temperature is preferably within the range of from 300° F. to 600° F. The liquid hourly space velocity of the reactants may range from about 0.5 to 2.5. It is preferred that the reaction zone charge stream is a mixed-phase stream when an SPA catalyst is used in the reaction zone. To insure this, the olefin feed stream may comprise light paraffins having the same number of carbon atoms per molecule as the olefin consumed in the process. The configuration and apparatus of the reaction zone may be that which is customarily used with the catalyst system selected for use in the process. With SPA catalysts, upward flow through vertical beds of catalyst is preferred. It is preferred that the added olefin comprises propylene or butene when an SPA catalyst is employed.

A stoichiometric excess of the olefinic hydrocarbon is maintained within the reaction zone by the admixture of a sufficient quantity of the olefin feed stream with the benzene-containing light hydrocarbon stream produced in the fractionation zone. That is, the olefin to benzene ratio in the reaction zone charge stream is maintained above 1.0:1.0. As benzene may not be the only aromatic hydrocarbon present in the reaction zone charge stream, the reaction charge stream should have a minimum light olefin to total aromatic hydrocarbon ratio of 1.0:1.0. Preferably this ratio is above 1.4:1.0, and more preferably, it is above 1.5:1.0 as this is believed necessary to achieve the alkylation of 95 mole percent of the benzene present in the reaction zone feed stream. However, a very large excess of the olefin leads to the production of polyalkylated aromatics boiling above the normally accepted gasoline boiling point curve end points. The aromatic hydrocarbon to olefin ratio is therefore preferably below 2.0:1.0, and more preferably below 1.8:1.0.

The reaction zone effluent stream will contain residual benzene, the $C_8$ to $C_{10}$ product of the alkylation reaction and other hydrocarbons such as the $C_4$ to $C_6$ paraffins which were in the light hydrocarbon stream. The reaction zone effluent stream is preferably cooled by indirect heat exchange and then passed into a separation zone. This separation zone may take different forms depending on the composition of the reaction zone effluent stream and the desired composition of the effluent of the process. For instance, any $C_2$ and $C_3$ hydrocarbons present in the reaction zone effluent stream will normally have to be entirely absent from the liquid product while some $C_4$ hydrocarbons are normally acceptable in gasolines. Consideration must also be given to the concentration of dissolved light olefins which can be tolerated in the heavy or liquid effluent stream of the separation zone. The apparatus used in the separation zone may therefore range from a single vapor-liquid separator or knock out vessel to a rectified stabilizer or debutanizer column. A simple vapor-liquid separator could be operated at a pressure slightly less than that used in the reaction zone and a temperature of from about 100° F. to 150° F. A stabilizer would be operated at the customary conditions for this widely practiced separation. The separation zone is preferably operated at conditions effective to remove substantially all hydrogen, methane, ethane and propane from the reaction zone effluent stream. These materials will be concentrated into a light separation zone effluent stream, which may also contain some $C_4$ hydrocarbons depending on the composition of the olefin feed stream. This stream may contain appreciable amounts of the olefin consumed in the reaction zone, and therefore all or a portion of it my be recycled for use in the process by admixture into the light hydrocarbon stream. The recycled portion of the light hydrocarbon stream may be passed through a purification zone to remove excessive amounts of unreactive light paraffins. The toluene and heavier aromatics and paraffins in the reaction zone effluent stream will be concentrated into a heavy separation zone effluent stream.

The heavy separation zone effluent stream is then admixed with the heavy or second hydrocarbon stream produced in the fractionation zone. The resultant combined stream is then transferred to a final blending system wherein it is adjusted to meet standards, such as octane number and volatility, which have been established for the desired gasoline.

In accordance with this description, the preferred embodiment of the invention may be characterized as a process for reducing the benzene content of a gasoline precursor stream which comprises the steps of passing a gasoline precursor stream comprising from 0.5 to 5.0 mole percent benzene, 1.0 mole percent toluene, 5.0 mole percent of $C_4$ to $C_6$ paraffinic hydrocarbons, 10 mole percent of $C_8$ to $C_{10}$ aromatic hydrocarbons and also comprising $C_7$ to $C_9$ paraffinic hydrocarbons and having a boiling point range between 90° F. and 410° F. into a fractionation zone operated at fractionation conditions and separating the gasoline precursor stream into a first hydrocarbon stream comprising $C_4$ to $C_6$ paraffinic hydrocarbons and substantially all of the benzene contained in the gasoline precursor stream and a second hydrocarbon stream comprising toluene and substantially all of the $C_8$ to $C_{10}$ aromatic hydrocarbons contained in the gasoline precursor stream; forming a reaction charge stream having an olefin to aromatic hydrocarbon ratio from about 1.5:1.0 to 1.8:1.0 by admixing a sufficient quantity of an olefin feed stream comprising propylene into the first hydrocarbon stream; contacting the reaction zone charge stream with an SPA catalyst in an alkylation reaction zone maintained at benzene alkylation-promoting conditions, and effecting the production of a reaction zone effluent stream which comprises an aromatic hydrocarbon having 9 carbon atoms per molecule and $C_4$ to $C_6$ paraffinic hydrocarbons and which contains less than 1.0 mole percent benzene; passing the reaction zone effluent stream into a separation zone and effecting the division of the reaction zone effluent stream into a light separation zone effluent stream comprising a $C_3$ hydrocarbon and a heavy separation zone effluent stream comprising substantially all of the aromatic hydrocarbons contained in the reaction zone effluent stream; and admixing the heavy separation zone effluent stream and the second hydrocarbon stream.

The subject process may be integrated into an existing of new refinery. This requires some changes in the operation of other refinery units, but reduces the overall costs of benzene removal. One embodiment of this integrated process is utilized in a refinery having both a catalytic reforming unit and a fluidized catalytic cracking (FCC) unit. The effluent of the reforming zone is customarily cooled and then debutanized in a rectified fractionation column. This produces an overhead vapor stream substantially free of $C_5$ and $C_6$ hydrocarbons. In this embodiment of the integrated benzene removal process, the operation of this column is changed to produce an overhead stream containing substantially all of the benzene originally in the reformate. The prior art debutanizer is thereby utilized as part of the fractionation zone which produces the light hydrocarbon stream which is passed into the alkylation zone. The $C_7$-plus bottoms product of this column is bypassed around the alkylation zone. This reduced the total amount of fractionation required to reduce the benzene content of the final gasoline product.

In this embodiment, the net bottoms stream of the stripping column used in the gas concentration unit associated with the fluidized catalytic cracking unit is passed into the fractionation zone which produces the light hydrocarbon stream passed into the benzene alkylation zone. The effluent of the benzene alkylation zone is debutanized to produce an overhead stream comprising $C_3$ and $C_4$ hydrocarbons from the stripping column bottoms and the hydrogen, methane and ethane which was present in the overhead stream of the column now utilized as a reformate dehexanizer. This debutanizer overhead stream may be handled in three ways. Preferably, it is passed into another fractionation column and most of the $C_3$ and $C_4$ hydrocarbons are removed. The remaining lighter material may then be passed into either a refrigerated deethanizer column or the primary absorber of the gas concentration unit. Alternatively, the debutanizer overhead stream may be passed directly into the primary absorber.

We claim as our invention:

1. A process for reducing the benzene content of a gasoline precursor stream which comprises the steps of:

(a) passing a gasoline precursor stream comprising from 0.5 to 5.0 mole percent benzene, 1.0 mole percent toluene, 5.0 mole percent of $C_4$ to $C_6$ paraffinic hydrocarbons, 10 mole percent $C_8$ to $C_{10}$ aromatic hydrocarbons and also comprising $C_7$ to $C_9$ paraffinic hydrocarbons and having a boiling point range between 90° F. and 410° F. into a fractionation zone operated at fractionation conditions and separating the gasoline precursor stream into a first hydrocarbon stream comprising $C_4$ to $C_6$ paraffinic hydrocarbons and substantially all of the benzene contained in the gasoline precursor stream and a second hydrocarbon stream comprising $C_8$ to $C_{10}$ aromatic hydrocarbons;

(b) forming a reaction zone charge stream having an olefin to aromatic hydrocarbon ratio above 1.0:1.0 by admixing an olefinic hydrocarbon having from 2 to 4 carbon atoms per molecule into the first hydrocarbon stream;

(c) passing the reaction zone charge stream into an alkylation reaction zone maintained at benzene alkylation-promoting conditions, and effecting the production of a reaction zone effluent stream which comprises an aromatic hydrocarbon having from 8 to 10 carbon atoms per molecule and $C_4$ to $C_6$ paraffinic hydrocarbons;

(d) passing the reaction zone effluent stream into a separation zone and effecting the division of the reaction zone effluent stream into a light separation zone effluent stream comprising a $C_3$ or $C_4$ hydrocarbon and a heavy separation zone effluent stream comprising substantially all of the aromatic hydrocarbons contained in the reaction zone effluent stream; and, (e) admixing the heavy separation zone effluent stream with the second hydrocarbon stream.

2. The process of claim 1 further characterized in that the reaction zone effluent stream contains less than 1.0 mole percent benzene.

3. The process of claim 1 further characterized in that the alkylation reaction zone contains a bed of an SPA catalyst.

4. The process of claim 3 further characterized in that the gasoline precursor stream comprises $C_6$ to $C_9$ aromatic hydrocarbons produced in a catalytic reforming zone.

5. A process for reducing the benzene content of a gasoline precursor stream which comprises the steps of:

(a) passing a gasoline precursor stream comprising from 0.5 to 5.0 mole percent benzene, 1.0 mole percent toluene, 5.0 mole percent of $C_4$ to $C_6$ paraffinic hydrocarbons, 10 mole percent of $C_8$ to $C_{10}$ aromatic hydrocarbons and also comprising $C_7$ to $C_9$ paraffinic hydrocarbons and having a boiling point range between 90° F. and 410° F. into a fractionation zone operated at fractionation conditions and separating the gasoline precursor stream into a first hydrocarbon stream comprising $C_4$ to $C_6$ paraffinic hydrocarbons and substantially all of the benzene contained in the gasoline precursor stream and a second hydrocarbon stream comprising toluene and substantially all of the $C_8$ to $C_{10}$ aromatic hydrocarbons contained in the gasoline precursor stream;

(b) forming a reaction zone charge stream having an olefin to aromatic hydrocarbon ratio from about 1.4:1:0 to 2.0:1.0 by admixing a sufficient quantity of an olefin feed stream comprising a $C_3$ or $C_4$ olefinic hydrocarbon into the first hydrocarbon stream;

(c) contacting the reaction zone charge stream with an SPA catalyst in an alkylation reaction zone maintained at benzene alkylation-promoting conditions, and effecting the production of a reaction zone effluent stream which comprises an aromatic hydrocarbon having 9 or 10 carbon atoms per molecule and $C_4$ to $C_6$ paraffinic hydrocarbons and which contains less than 1.0 mole percent benzene;

(d) passing the reaction zone effluent stream into a separation zone and effecting the division of the reaction zone effluent stream into a light separation zone effluent stream comprising a $C_3$ or $C_4$ hydrocarbon and a heavy separation zone effluent stream comprising substantially all of the aromatic hydrocarbons contained in the reaction zone effluent stream; and, (e) admixing the heavy separation zone effluent stream and the second hydrocarbon stream.

6. The process of claim 5 further characterized in that the olefin to aromatic hydrocarbon ratio of the reaction zone charge stream is from about 1.5:1 to 1.8:1.

7. The process of claim 6 further characterized in that the reaction zone charge stream is a mixed phase stream when contacted with the SPA catalyst.

8. The process of claim 7 further characterized in that the olefin feed stream comprises propylene and propane.

9. The process of claim 7 further characterized in that a portion of the light separation zone effluent stream is recycled by admixture into the first hydrocarbon stream and in that the light separation zone effluent stream comprises propylene.

* * * * *